US008387901B2

(12) United States Patent
Flynn et al.

(10) Patent No.: US 8,387,901 B2
(45) Date of Patent: Mar. 5, 2013

(54) JET FOR USE IN A JET MILL MICRONIZER

(75) Inventors: Harry E. Flynn, Edmond, OK (US); Robert O. Martin, Edmond, OK (US); Charles A. Natalle, Pampa, TX (US)

(73) Assignee: Tronox LLC, Oklahoma City, OK (US)

( * ) Notice: Subject to any disclaimer, the term of this patent is extended or adjusted under 35 U.S.C. 154(b) by 698 days.

(21) Appl. No.: 12/518,867

(22) PCT Filed: Dec. 14, 2006

(86) PCT No.: PCT/US2006/047707

§ 371 (c)(1), (2), (4) Date: Jun. 11, 2009

(87) PCT Pub. No.: WO2008/073094

PCT Pub. Date: Jun. 19, 2008

(65) Prior Publication Data

US 2010/0025502 A1 Feb. 4, 2010

(51) Int. Cl.
*B05B 1/04* (2006.01)

(52) U.S. Cl. ..... 239/592; 239/594

(58) Field of Classification Search ..... 239/592, 239/589, 590, 594, 595, 599, 601, DIG. 7, 239/DIG. 8

See application file for complete search history.

(56) References Cited

U.S. PATENT DOCUMENTS

| | | | | |
|---|---|---|---|---|
| 2,052,869 | A * | 9/1936 | Coanda | 239/418 |
| 3,240,254 | A * | 3/1966 | Hughes | 122/24 |
| 3,302,887 | A * | 2/1967 | Holmes et al. | 239/265.23 |
| 3,713,590 | A * | 1/1973 | Dorschner et al. | 28/283 |
| 4,018,388 | A | 4/1977 | Andrews | |
| 4,155,850 | A | 5/1979 | Rathbone et al. | |
| 4,184,636 | A | 1/1980 | Bauer | |
| 4,248,387 | A | 2/1981 | Andrews | |
| 4,252,512 | A | 2/1981 | Kornylak | |
| 4,300,033 | A | 11/1981 | Scarton et al. | |
| 4,302,134 | A | 11/1981 | Johnson, Jr. et al. | |
| 4,339,081 | A | 7/1982 | Lindqvist | |
| 4,344,479 | A | 8/1982 | Bailey | |
| 4,370,538 | A | 1/1983 | Browning | |
| 4,458,729 | A | 7/1984 | Brouwer et al. | |
| 4,484,710 | A | 11/1984 | Rozniecki | |

(Continued)

FOREIGN PATENT DOCUMENTS

| | | |
|---|---|---|
| EP | 0 573 933 A1 | 12/1993 |
| EP | 0 894 026 B1 | 12/2002 |

(Continued)

OTHER PUBLICATIONS

Dattus™ fM Meter Technical Reference Guide, Actaris metering systems, Chapter 2, p. 2-1, publisher and date unknown.

(Continued)

*Primary Examiner* — Davis Hwu
(74) *Attorney, Agent, or Firm* — McAfee & Taft

(57) ABSTRACT

The current invention provides an improved jet nozzle suitable for use in a micronizing jet mill or retrofitting to an existing jet mill. The improved jet nozzle incorporates a coanda effect inducing element to enhance entrainment of particles to be ground within the vortex created by the micronizing jet mill. When the jet mill uses steam to generate the jet, use of the improved nozzle will reduce energy costs by increasing the efficiency of the jet mill.

13 Claims, 6 Drawing Sheets

U.S. PATENT DOCUMENTS

| | | | | |
|---|---|---|---|---|
| 4,489,825 | A | 12/1984 | Gladish | |
| 4,531,592 | A | 7/1985 | Hayatdavoudi | |
| 4,550,823 | A | 11/1985 | Gladish | |
| 4,558,822 | A | 12/1985 | Nieuwkamp et al. | |
| 4,621,684 | A | 11/1986 | Delahunty | |
| 4,687,079 | A | 8/1987 | Gladish | |
| 4,691,745 | A | 9/1987 | Takekawa et al. | |
| 5,016,823 | A | 5/1991 | Kato et al. | |
| 5,135,167 | A | 8/1992 | Ringer | |
| 5,347,805 | A | 9/1994 | Butzke et al. | |
| 5,423,490 | A | 6/1995 | Zampini | |
| 5,628,464 | A | 5/1997 | Smith et al. | |
| 5,683,039 | A * | 11/1997 | Leute et al. | 241/5 |
| 5,732,893 | A | 3/1998 | Nied | |
| 5,749,525 | A | 5/1998 | Stouffer | |
| 5,849,453 | A | 12/1998 | Mikuriya et al. | |
| 5,895,869 | A | 4/1999 | Von Behrens et al. | |
| 5,983,735 | A | 11/1999 | Von Behrens et al. | |
| 6,123,542 | A | 9/2000 | Joshi et al. | |
| 6,142,425 | A | 11/2000 | Armanios et al. | |
| 6,210,151 | B1 | 4/2001 | Joshi et al. | |
| 6,276,924 | B1 | 8/2001 | Joshi et al. | |
| 6,408,866 | B1 | 6/2002 | Carver et al. | |
| 6,709,630 | B2 | 3/2004 | Cameron et al. | |
| 6,780,917 | B2 | 8/2004 | Hashimoto et al. | |
| 6,826,910 | B1 * | 12/2004 | Easton | 60/597 |
| 6,942,170 | B2 | 9/2005 | Casalmir et al. | |
| 6,951,312 | B2 | 10/2005 | Casalmir et al. | |
| 6,976,507 | B1 | 12/2005 | Webb et al. | |
| 7,334,427 | B2 * | 2/2008 | Ozaki et al. | 62/500 |
| 7,354,029 | B1 * | 4/2008 | Rutstein | 261/76 |
| 7,404,416 | B2 | 7/2008 | Schultz et al. | |
| 7,438,245 | B2 * | 10/2008 | Kawamoto et al. | 241/40 |
| 2005/0072866 | A1 | 4/2005 | Petit | |
| 2006/0151641 | A1 | 7/2006 | Li | |

FOREIGN PATENT DOCUMENTS

| | | | |
|---|---|---|---|
| EP | 1 300 445 | A1 | 4/2003 |
| EP | 1 316 621 | A2 | 6/2003 |
| EP | 0 999 411 | B1 | 11/2004 |
| GB | 639762 | | 7/1950 |
| GB | 1 543 371 | | 4/1979 |
| GB | 2 006 148 | A | 5/1979 |
| GB | 2 009 624 | A | 6/1979 |
| GB | 2 035 846 | A | 6/1980 |
| GB | 2 038 209 | A | 7/1980 |
| GB | 2 065 505 | A | 7/1981 |
| GB | 2 125 710 | A | 3/1984 |
| GB | 2 276 708 | A | 10/1994 |
| JP | S63-205159 | A | 8/1988 |
| JP | H06-285384 | A | 10/1994 |
| JP | H11-319674 | A | 11/1999 |
| JP | 2000-093831 | A | 4/2000 |
| WO | WO 80/00368 | | 3/1980 |
| WO | WO 00/19881 | | 4/2000 |
| WO | WO 2008/073094 | A1 | 6/2008 |

OTHER PUBLICATIONS

Sturtevant, Inc., "Jet Mill Micronizer by Sturtevant," (2004).
Sturtevant, Inc., "Sanitary Design Micronizer" (2005).
Moore Process Automation Solutions, "Flowmeters," pp. 305-319, undated but admitted to be prior art, discovered in Oct. 2006.
IPRP for PCT/US2006/47707, completed Oct. 29, 2009, Tronox LLC.
European Search Report mailed Dec. 12, 2010 in Applicant's corresponding European application, Application No. 06845418.0.
First Office Action mailed Jun. 21, 2011 in Applicant's corresponding Chinese application, application No. 200680056641.2.
Written Opinion mailed Nov. 19, 2010 in Applicant's corresponding Singapore application, Application No. 200903961-1.
Examination Report mailed May 8, 2012 in Applicant's corresponding Singapore application, Application No. 200903961-1.
Examiner's First Report, mailed Dec. 6, 2010 in Applicant's corresponding Australian application, Application No. 2006351884.
Notice of Acceptance mailed Jul. 27, 2011 in Applicant's corresponding Australian application, Application No. 2006351884.
Second office Action mailed Jun. 14, 2012 in Applicant's corresponding Chinese application, application No. 200680056641.2 (and English translation).
Substantive Examination Adverse Report mailed Sep. 28, 2012 in Applicant's corresponding Malaysian application, Application No. PI 20092366.

* cited by examiner

JET FOR USE IN A JET MILL MICRONIZER

BACKGROUND OF THE INVENTION

Jet mill micronizers are commonly used to reduce the particle size of friable material to the micron range. Typical jet mill micronizers feed the friable material into a vortex created by injection of a fluid such as compressed air, gas or steam through a nozzle into the micronizer. The vortex entrains the friable material and accelerates it to a high speed. Subsequent particle on particle impacts within the micronizer create increasingly smaller particles, with particles of the desired size ultimately moving to the center of the micronizer where they exit through a vortex finder.

The efficiency of the micronizer is dictated by the ability to properly entrain the friable material within the jet stream created by the injected gas. Over the years, the industry has attempted to improve the entrainment of the particles through changes in nozzle design as well as through recirculation devices incorporated into the micronizer. While such efforts have met with limited success, they frequently rely upon complicated designs subject to wear and increased maintenance.

One attempt to improve the efficiency of a micronizer resulted in the development and use of the now standard convergent-divergent nozzles. Converging-diverging nozzles generate extremely high velocity gaseous streams commonly achieving supersonic velocities. However, because the gaseous streams expand within the nozzle, entrainment of particles within the resulting jet is difficult. Thus, the benefits of the supersonic velocity are not generally imparted to the friable material.

High pressure steam is commonly used to generate the micronizing jet when milling titanium dioxide particles to pigmentary size. In view of the energy costs associated with steam generation, improved entrainment efficiencies can lead to significant cost savings during the $TiO_2$ pigment manufacturing process. The quantity of steam used during the $TiO_2$ micronization process, for example, is typically quite substantial, generally varying between about 0.5 to greater than two tons per ton of pigment.

In view of the significant energy costs associated with steam jet mills, it would be desirable to provide an improved jet nozzle which enhances entrainment of particles to be milled. Preferably, such improvements would be provided without significant design changes to the micronizer. Further, it would be even more beneficial if the changes enabling the improved operations of the micronizer could be readily retrofitted to existing units. The current invention, as described herein, provides for each of the above needs through an improved micronizer jet nozzle.

SUMMARY OF THE INVENTION

The current invention provides an improved jet nozzle for use in a micronizing jet mill. The nozzle of the current invention includes a nozzle body having a passageway extending from a first open end to a second open end suitable for forming a gaseous jet. Located within the passageway is a Coanda effect inducing element. Preferably, the Coanda effect inducing element extends outwardly from the exit (second end) of the passageway.

In another embodiment, the current invention provides an improved jet nozzle for use in a micronizing jet mill. The jet nozzle has a nozzle body with a conduit passing through the length of the nozzle body providing a passageway for generating a gaseous jet. The exit point of the nozzle forming the gaseous jet preferably has a slot-like design. Positioned within the passageway and preferably extending outwards from the exit point of the passageway is a Coanda effect inducing element. Preferably, the Coanda effect inducing element has a configuration corresponding to the slot-like exit of the passageway. Thus, the slot-like exit of the passageway and the Coanda effect inducing element define a generally consistent gap suitable for generating the steam jet.

Still further, the current invention provides an improved jet nozzle for use in a micronizing jet mill. The improved nozzle comprises a nozzle body with a passageway passing the length of the nozzle body for generating a gaseous jet. The exit point of the nozzle has a slot-like design defined by two longer, essentially inwardly hyperbolic sides and two opposing generally rounded ends. Removably positioned within the passageway and preferably extending outwards from the exit point of the passageway is a Coanda effect inducing element. Preferably, the removable Coanda effect inducing element has a configuration corresponding to the slot-like exit of the passageway. Thus, the slot-like exit of the passageway and the Coanda effect inducing element define a generally consistent gap through which the gaseous steam flows to form the jet. While other means may be employed to secure the Coanda effect inducing element in position within the nozzle, the preferred embodiment utilizes a hollow set screw having a passageway running the length of the screw. The screw is inserted into the first end of the jet nozzle following placement of the Coanda effect inducing element within the nozzle, thereby securing the Coanda effect inducing element in position within the nozzle.

BRIEF DESCRIPTION OF THE DRAWING

FIG. 6 depicts the improved entrainment of particles when using the jet nozzle of the current invention.

DETAILED DESCRIPTION OF PREFERRED EMBODIMENTS OF THE INVENTION

In 1910, Henri Coanda first observed a phenomenon wherein a free jet emerging from a nozzle attached itself to a nearby surface. Known as the Coanda effect, this phenomenon is the result of low pressure developing between the free flowing stream of gas and the wall. The Coanda effect can be observed in both liquid and gaseous fluids.

Figure 4:
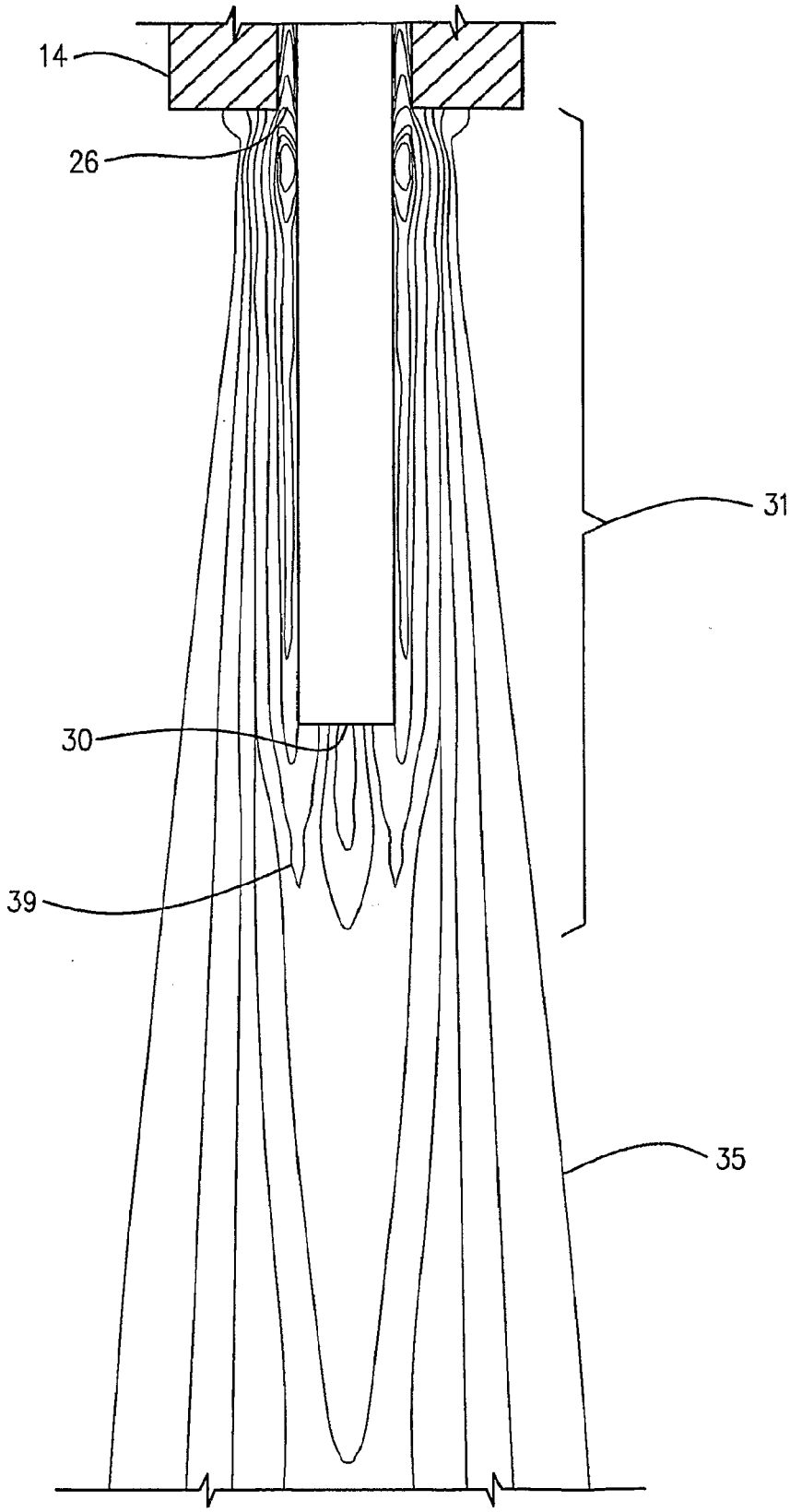
FIG. 4 depicts the extension of the Coanda effect beyond the exit point of the jet nozzle and represents the speed of the gaseous jet.

The current invention takes advantage of the Coanda effect to extend a thin layer supersonic zone 31 outward from the jet nozzle 10. As depicted in FIG. 4, the current invention extends supersonic zone 31 at least one inch outward from the exit point 26 of the nozzle 10. When used in a titanium dioxide micronizing process, the current invention provides an effective grinding zone equal to currently available full cone jet nozzles. The nozzle of the current invention provides this equivalent grinding zone while reducing the steam requirements by half. Thus, the current invention satisfies the above indicated needs of the industry.

Figure 1:
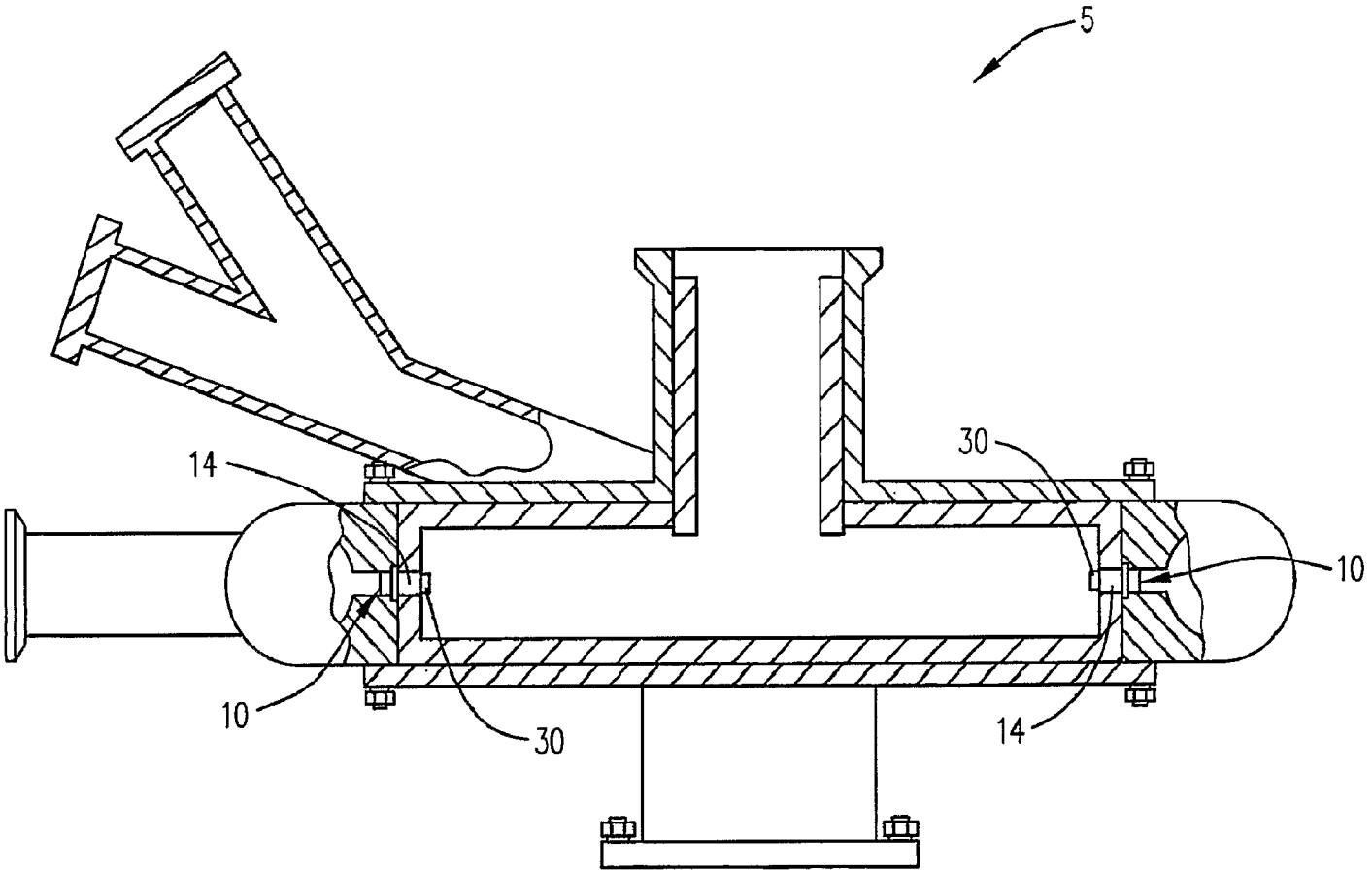
FIG. 1 depicts a typical micronizing jet mill.

Preferred embodiments of the current invention will be described with reference to FIGS. 1-3 and in particular with reference to FIGS. 2 and 3. FIG. 1 depicts a typical micronizer jet mill 5 which may be retrofitted with improved jet nozzle 10 of the current invention.

Figure 2:
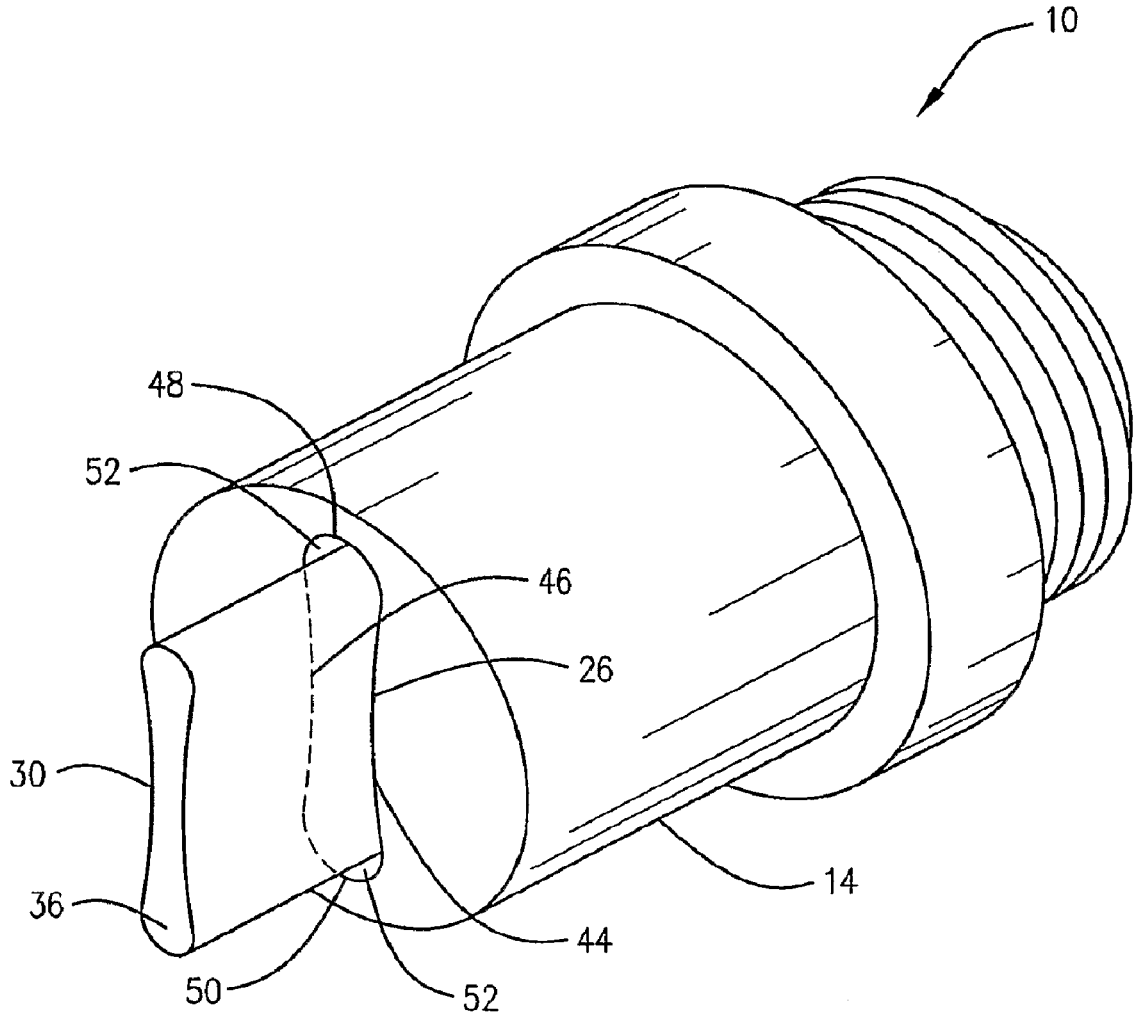
FIG. 2 is a perspective view of a preferred embodiment of an improved jet nozzle, including the Coanda effect inducing element positioned within the jet nozzle.
Figure 3:
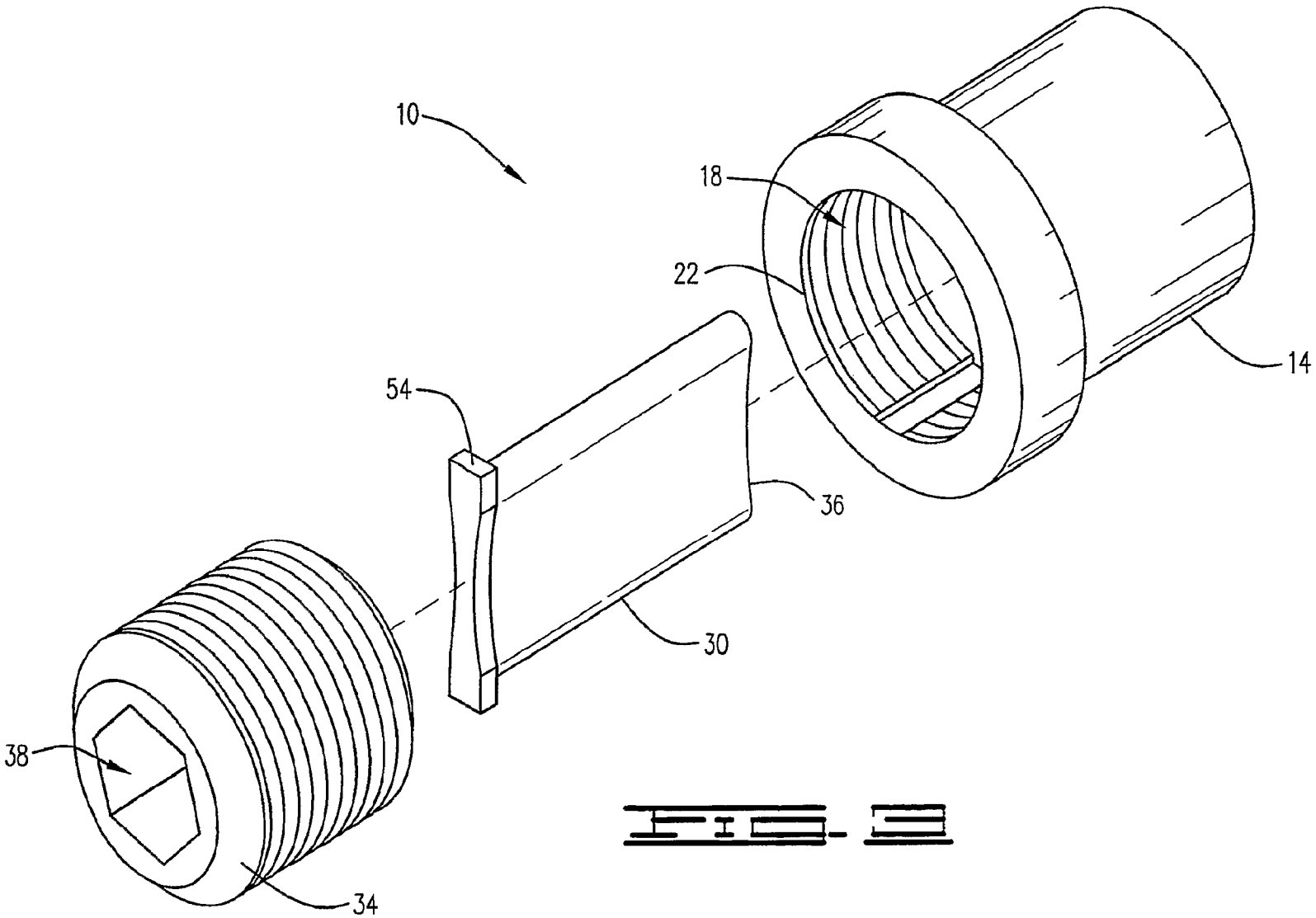
FIG. 3 is an exploded view of the improved jet nozzle of FIG. 2.

Improved jet nozzle 10 of the current invention is depicted in detail in FIGS. 2 and 3. With reference of FIG. 3, nozzle 10 includes a nozzle body 14 having a passageway 18 therethrough. Passageway 18 has a first open end 22 and second open end 26 also referred to herein as the exit point 26 or jet forming exit 26. Located within passageway 18 and preferably extending outward from exit point 26 is a Coanda effect inducing element 30. Coanda effect inducing element 30 extends outwards from exit point 26 a distance sufficient to ensure development of the Coanda effect. Typically, this distance is between about 2.5 mm (0.1 inch) and about 38.1 mm (1.5 inches).

As depicted in FIG. 2, Coanda effect inducing element 30 preferably has a configuration which conforms to the configuration of exit point 26. Finally, in a preferred embodiment, Coanda effect inducing element 30 is preferably removably secured within passageway 18 by a retainer such as a set screw 34. Set screw 34 also has a conduit or passageway 38 extending through screw 34. Thus, when installed within micronizer 5, compressed gas or steam at a pressure suitable for forming the desired jet initially enters nozzle 10 by passing through screw 34 into nozzle body 14 and exiting at exit point 26. As mentioned above, other options are available for removably securing the element 30 in position within passageway 18, including using a snap ring attachment, an indexed friction fit or even a tack weld of the element 30 within the passageway 18.

As the steam jet exits nozzle body 14, it will be attracted to and maintained in close proximity to Coanda effect inducing element 30 by the Coanda effect. Due to the induced Coanda effect, the resulting jet's supersonic zone 31 will be extended outward from nozzle 10 a greater distance than would be true of a jet under the same pressure and temperature conditions, without using Coanda effect inducing element 30.

As shown in FIG. 4, supersonic zone 31 is extended at least one inch beyond exit point 26. FIG. 4 further provides a depiction of the speed of the resulting jet in gray scale. As shown, even the lower edge 39 of supersonic zone 31 retains a significant jet velocity. Typically, jet velocity at the lower edge 39 of supersonic zone 31 will be about Mach 1.8 to about Mach 1.9. In contrast, prior art devices lacking a Coanda effect inducing element 30 would experience rapid dissipation of the jet in the region adjacent to nozzle 10. In general, jet velocities in the corresponding regions without use of element 30 would normally be about Mach 1, and require approximately 2× as much steam to attain a zone of less than equivalent length. The improved velocities throughout supersonic zone 31 produce enhanced entrainment of particles within jet region 35.

Figure 5:
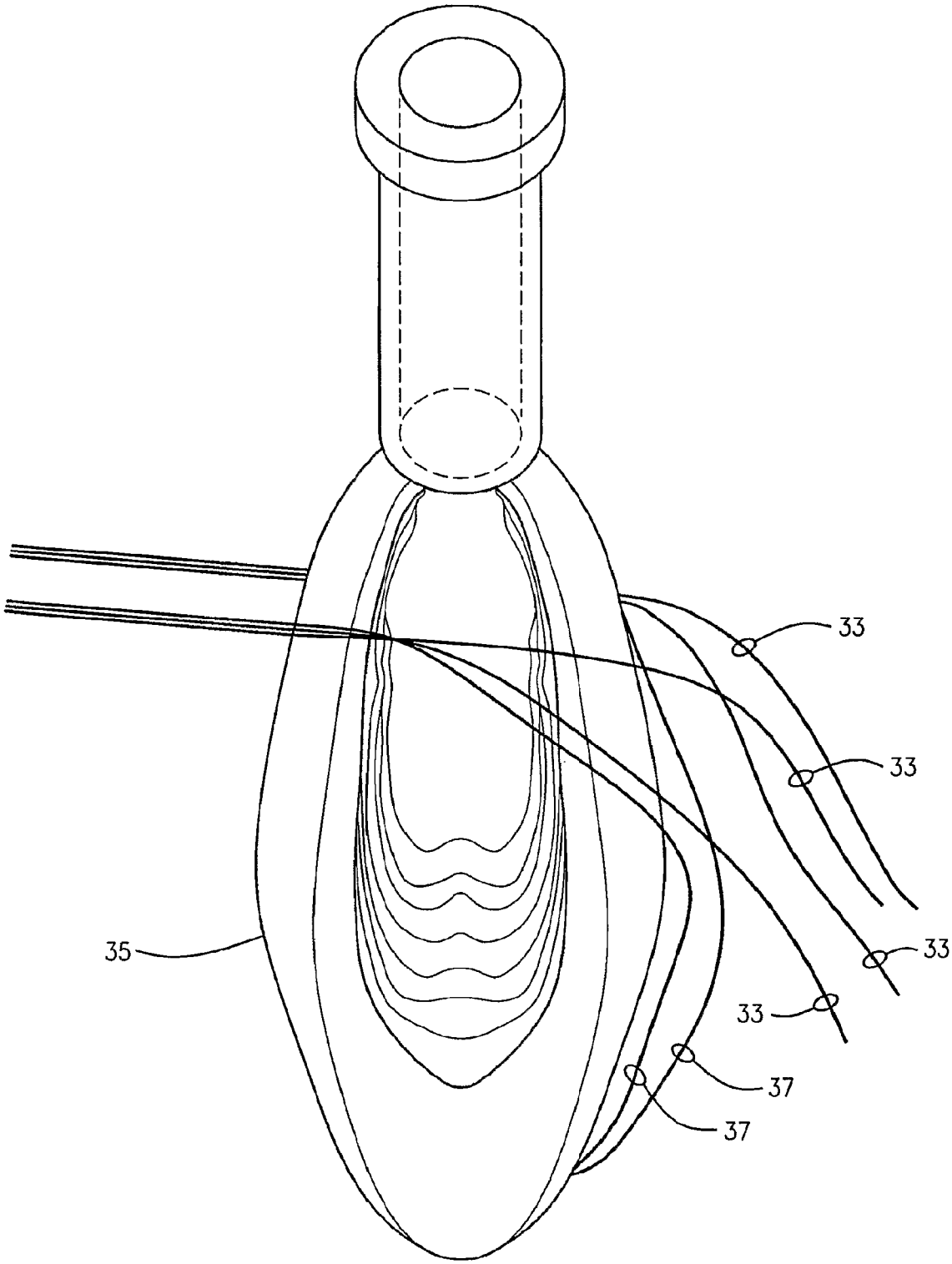
FIG. 5 depicts the deflection of particles around the gaseous jet when using a prior art nozzle.
Figure 5:
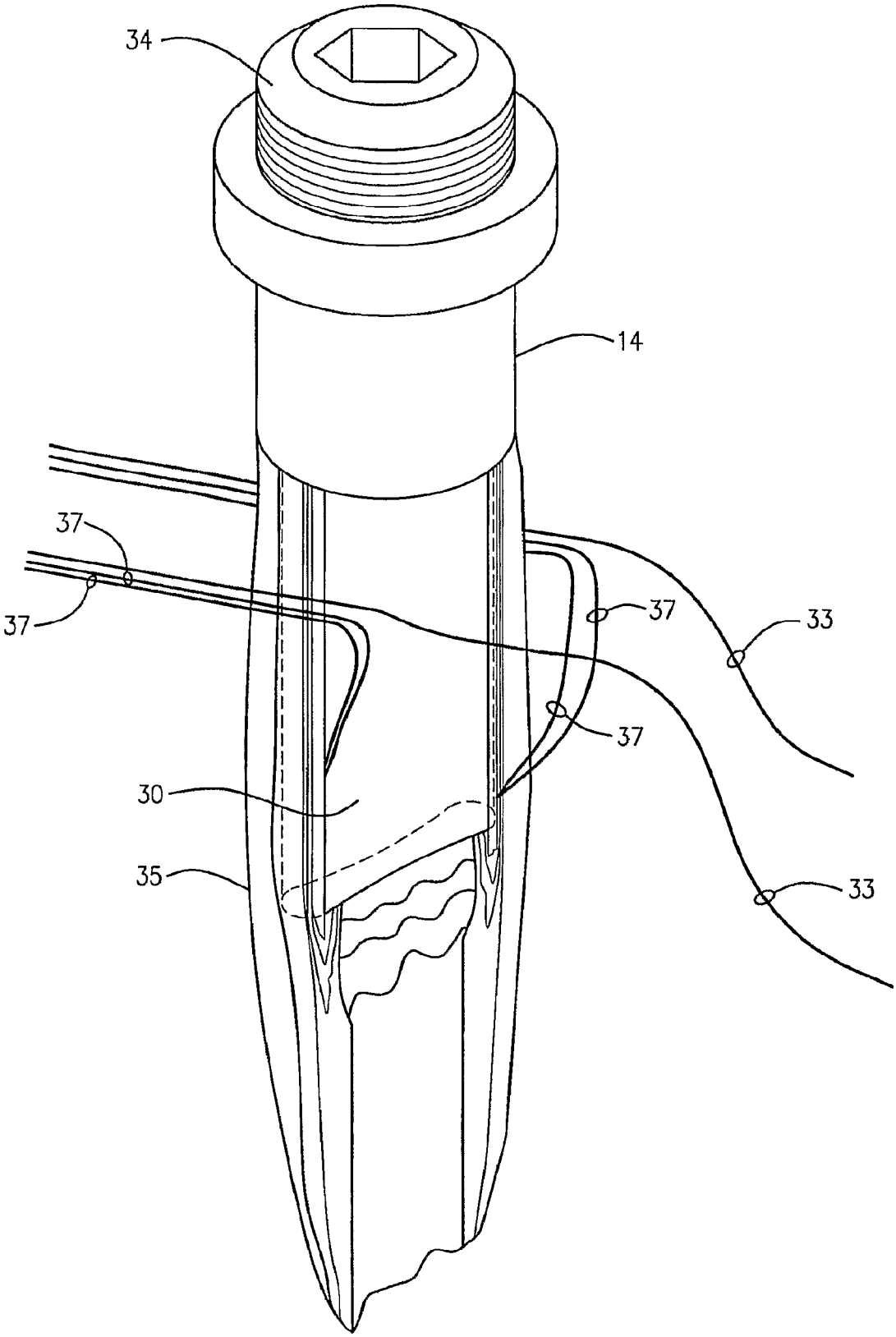

The improved entrainment of particles within supersonic zone 31 is evident from a comparison of FIG. 5 to FIG. 6. FIGS. 5 and 6 depict the influence of jet region 35 on representative particle tracking lines 33 and 37. In FIG. 6, the particle tracking lines indicate that four representative particle tracks 37 are drawn into supersonic zone 31 while only two particle tracks 33 do not enter supersonic zone 31. In contrast, FIG. 5 depicts operating the jet without Coanda effect inducing element 30. As shown in FIG. 5, four particle tracks 33 do not enter jet region 35, with only two particle tracks 37 being entrained by jet region 35. Thus, use of Coanda effect inducing element 30 within nozzle 10, as depicted in FIGS. 4 and 6, increases the efficiency of supersonic zone 31, thereby enabling a corresponding reduction in steam usage for a desired degree of grinding.

In the preferred embodiment, exit point 26 preferably has a modified slot-like configuration wherein opposing walls 44 and 46 are pinched inwards toward one another, each presenting a generally inwardly hyperbolic shape, with the opposing shorter ends 48 and 50 being generally rounded in configuration. To obtain maximum efficiency of nozzle 10, Coanda effect inducing element 30 preferably has a configuration which conforms to the configuration of exit point 26. Typically, the conforming configuration extends from exit point 26 into passageway 18 a distance of about ten times (10×) to about twenty times (20×) the width of the air passage or gap 52 defined between the outer surface of Coanda effect inducing element 30 and the inner surface of exit point 26. Thus, if gap 52 is about 0.254 mm (about 0.01") wide, then the conforming configuration will extend about 2.54 mm to about 10.16 mm (about 0.1" to about 0.2") into passageway 18. Alternatively, the conforming configuration may characterize the entire length of Coanda effect inducing element 30 from end 36 to flange 54 or some intermediate distance.

In alternative embodiments, exit point 26 may have a different configuration than depicted in FIGS. 1 and 2. For example, exit point 26 may have a conventional slot like opening wherein sidewalls 44, 46 are essentially parallel with rounded or squared ends 48, 50. Preferably, Coanda effect inducing element 30 used in conjunction with exit point 26 will have a corresponding configuration. However, the current invention contemplates the use of Coanda effect inducing element 30 having a configuration which does not conform to the configuration of exit point 26. For example, Coanda effect inducing element 30 may have an oval, elliptic or any other curved surface suitable for inducing a Coanda effect on the steam exiting the nozzle body 14 while exit point 26 may be a standard slot opening or other configuration including but not limited to oval, circular, multi-slotted and multi-lobed.

In a preferred embodiment, Coanda effect inducing element 30 carries a flange 54 suitable for retaining Coanda effect inducing element 30 within passageway 18 by engaging a lip or other similar device (not shown). Following positioning of Coanda effect inducing element 30 within passageway 18, set screw 34 is threaded into nozzle body 14. Although shown as having a fixed position within nozzle body 14, Coanda effect inducing element 30 may be adjustably secured within passageway 18 thereby allowing fine tuning of micronizer 5 for changes in operating conditions. Methods for adjustably securing Coanda effect inducing element 30 within passageway 18 are well known to those skilled in the art and will typically use a solenoid or stepper motor operating in a manner similar to an idle air control valve commonly found a modern fuel injected engine.

In addition to the benefits depicted by FIG. 6, the current invention also provides a thicker supersonic zone. Thus, the current invention further improves entrainment of particles by extending the supersonic jet further into the layer of particles entering micronizer 5. Additionally, stabilization of the supersonic zone by use of the current invention enhances back flow of particles into the resulting jet.

While preferred embodiments of the present invention have been illustrated for the purpose of the present disclosure, other embodiments of the current invention will be apparent to those skilled in the art from a consideration of this specification, the drawings or practice of the invention disclosed herein. Thus, the foregoing disclosure will enable the construction of a wide variety of apparatus within the scope of the following claims. Accordingly, the foregoing specification is considered merely exemplary of the current invention with the true scope and spirit of the invention being indicated by the following claims.

We claim:

1. A jet nozzle suitable for use in a micronizing jet mill and constructed and arranged to provide a gaseous jet that creates a supersonic zone for grinding friable materials, comprising:

a nozzle body having a first open end and a second open end with a passageway joining said first and second ends; and a Coanda effect inducing element positioned within said passageway and extending outward from said second end of said nozzle, said Coanda effect inducing element extending outward from said second end of said nozzle for a distance sufficient to ensure development of a Coanda effect and thereby extend said supersonic grinding zone outward from said nozzle body.

2. The jet nozzle of claim 1, wherein said Coanda effect inducing element has a geometric configuration corresponding to a geometric configuration of said second open end of said nozzle body.

3. The jet nozzle of claim 2, wherein said second open end of said nozzle body has a slot-like configuration.

4. The jet nozzle of claim 2, wherein said second open end of said nozzle body has a slot-like configuration defined by two longer, essentially inwardly hyperbolic sides and opposing generally rounded ends.

5. The jet nozzle of claim 1, wherein said Coanda effect inducing element extends outwardly from said second open end a distance of from about 2.5 mm to about 38.1 mm and wherein said Coanda effect inducing element has a geometric configuration corresponding to a geometric configuration of said second open end of said nozzle body.

6. The jet nozzle of claim 3, wherein an exterior surface of said Coanda effect inducing element and an interior surface of said second open end define a gap, and wherein the portion of said Coanda effect inducing element which conforms to the configuration of said second open end extends into said passageway a distance ranging from about ten times said gap to about 20 times said gap.

7. The jet nozzle of claim 3, wherein said first open end of said nozzle body carries interior threads and an exterior surface of said Coanda effect inducing element and an interior surface of said second open end define an air passage, and said jet nozzle further comprises a Coanda effect inducing element retainer positioned within the first end of said nozzle, thereby securing said Coanda effect inducing element within said passageway.

8. The jet nozzle of claim 7, wherein said retainer has a passageway passing therethrough.

9. The jet nozzle of claim 1, wherein said Coanda effect inducing, element is adjustably positioned within said passageway joining said first and second open ends of said nozzle body.

10. The jet nozzle, of claim 5, wherein an exterior surface of said Coanda effect inducing element and an interior surface of said second open end define a gap, and wherein the portion of said Coanda effect inducing element which confirms to the geometric configuration of said second open end extends into said passageway a distance ranging about ten times said gap to about 20 times said gap.

11. The jet nozzle of claim 10, wherein said second open end of said nozzle body has a slot-like configuration defined by two longer, essentially inwardly hyperbolic sides and opposing generally rounded ends.

12. A jet nozzle suitable for use in a micronizing jet mill and constructed and arranged to provide a gaseous jet that creates a supersonic zone for grinding friable materials, comprising:

a nozzle body having a first open end and a second open end with a passageway joining said first and second ends; and a Coanda effect inducing element positioned within said passageway and extending outward from said second end of said nozzle, said Coanda effect inducing element extending outward from said second end of said nozzle for a distance sufficient to ensure development of a Coanda effect and thereby extend said supersonic grinding zone outward from said nozzle body, wherein said Coanda effect inducing element has a geometric configuration corresponding to a geometric configuration of said second open end of said nozzle body, and wherein said second open end of said nozzle body has a slot-like configuration defined by two longer, essentially inwardly hyperbolic sides and opposing generally rounded ends.

13. A jet nozzle suitable for use in a micronizing jet mill and constructed and arranged to provide a gaseous jet that creates a supersonic zone for grinding friable materials, comprising:

a nozzle body having a first open end and a second open end with a passageway joining said first and second ends; and a Coanda effect inducing element positioned within said passageway and extending end outward from said second end of said nozzle, said Coanda effect inducing element extending outward from said second end of said nozzle for a distance sufficient to ensure development of a Coanda effect and thereby extend said supersonic grinding zone outward from said nozzle body, wherein said Coanda effect inducing element has a geometric configuration corresponding to a geometric configuration of said second open end of said nozzle body, wherein said second open end of said nozzle body has a slot-like configuration, and wherein an exterior surface of said Coanda effect inducing element and an interior surface of said second open end define a gap, and wherein the portion of said Coanda effect inducing element which conforms to the configuration of said second open end extends into said passageway a distance ranging from about ten times said gap to about 20 times said gap.

* * * * *

UNITED STATES PATENT AND TRADEMARK OFFICE

CERTIFICATE OF CORRECTION

PATENT NO. : 8,387,901 B2
APPLICATION NO. : 12/518867
DATED : March 5, 2013
INVENTOR(S) : Harry E. Flynn et al.

It is certified that error appears in the above-identified patent and that said Letters Patent is hereby corrected as shown below:

In the Claims

Column 5, line 52 (line 2 of claim 9), delete the "," between "inducing" and "element."

Column 5, line 55 (line 1 of claim 10), delete the "," between "nozzle" and "of."

Column 6, line 1 (line 4 of claim 10), delete "confirms" and insert --conforms-- therefor.

Column 6, line 38 (line 9 of claim 13), delete "end" between "extending" and "outward."

Signed and Sealed this
Nineteenth Day of November, 2013

Teresa Stanek Rea
*Deputy Director of the United States Patent and Trademark Office*